US005559579A

United States Patent [19]

Gwaltney et al.

[11] Patent Number: 5,559,579

[45] Date of Patent: Sep. 24, 1996

[54] CLOSED-LOOP DEVELOPABILITY CONTROL IN A XEROGRAPHIC COPIER OR PRINTER

[75] Inventors: Mark A. Gwaltney; Robert E. Grace, both of Fairport, N.Y.

[73] Assignee: Xerox Corporation, Stamford, Conn.

[21] Appl. No.: 315,018

[22] Filed: Sep. 29, 1994

[51] Int. Cl.[6] ..... G03G 21/00

[52] U.S. Cl. ..... 355/208; 355/246

[58] Field of Search ..... 355/245, 208, 355/207, 246; 118/688–691

[56] References Cited

U.S. PATENT DOCUMENTS

| | | | |
|---|---|---|---|
| 3,529,546 | 9/1970 | Keller | 101/426 |
| 4,377,338 | 3/1983 | Ernst | 118/663 |
| 4,413,264 | 11/1983 | Cruz-Uribe et al. . | |
| 4,502,778 | 3/1985 | Dodge et al. | 355/208 |
| 4,618,248 | 10/1986 | Buchar | 355/208 |
| 4,647,184 | 3/1987 | Russell et al. | 35/208 |
| 4,829,336 | 5/1989 | Champion et al. | 355/246 |
| 4,847,659 | 7/1989 | Resch, III | 355/202 |
| 4,908,666 | 3/1990 | Resch, III | 355/246 |
| 4,985,320 | 1/1991 | Griffin | 430/30 |
| 5,150,155 | 9/1992 | Rushing | 355/208 |
| 5,175,585 | 12/1992 | Matsubayashi et al. | 355/208 |
| 5,202,769 | 4/1993 | Suzuki | 358/300 |
| 5,204,698 | 4/1993 | LeSueur et al. . | |
| 5,204,699 | 4/1993 | Birnbaum et al. . | |
| 5,210,572 | 5/1993 | MacDonald et al. | 355/208 |
| 5,227,270 | 7/1993 | Schauer et al. | 430/31 |
| 5,315,352 | 5/1994 | Nakane et al. | 355/246 |
| 5,386,276 | 1/1995 | Swales et al. | 355/246 |

*Primary Examiner*—Thu Anh Dang

[57] ABSTRACT

A developer control for enabling the use of developer and toner materials with widely varying At in high quality xerographic copying and printing. Pixel count data is combined with toner test patch reflectance data during a brief toner rundown to determine the rate of change of density per unit change in toner concentration. During toner rundown, dispensing of toner is suspended for a period of time for effecting toner concentration reduction by approximately 0.25%. The change in Toner Concentration (TC) is estimated using pixel counting. Additionally, toner test patches are created and the reflectance thereof is measured for determining the change in toner density. The estimated TC change and the change in toner density are processed using linear regression to find the average change in density sensor output for the estimated change in TC which is referred to as the rundown slope. The rundown slope is then compared to a target value. If it exceeds the target value by more than ? (a noise factor), the dispense setpoint is reduced by one unit. If the rundown slope is less than the target value by more than ?, the dispense point is increased by one unit. The noise factor, ? is attributable to errors in pixel count or reflectance sensor drift. According to the foregoing, the nominal control line and control band in TC-Tribo space is altered to produce a much wider usable At range.

18 Claims, 5 Drawing Sheets

CLOSED-LOOP DEVELOPABILITY CONTROL IN A XEROGRAPHIC COPIER OR PRINTER

BACKGROUND OF THE INVENTION

This invention relates generally to toner image creation and more particularly to developability control which enables a wider usable $A_t$ (i.e. a toner material's effectiveness in charging with a given carrier) range.

The invention can be utilized in the art of xerography or in the printing arts. In the practice of conventional xerography, it is the general procedure to form electrostatic latent images on a xerographic surface by first uniformly charging a photoreceptor. The photoreceptor comprises a charge retentive surface. The charge is selectively dissipated in accordance with a pattern of activating radiation corresponding to original images. The selective dissipation of the charge leaves a latent charge pattern on the imaging surface corresponding to the areas not exposed by radiation.

A common type of developer comprises carrier granules having toner particles adhering triboelectrically thereto. The two-component mixture is brought into contact with the photoconductive surface, where the toner particles are attracted from the carrier granules to the latent image. This forms a toner powder image on the photoconductive surface which is subsequently transferred to a receiving substrate such as plain paper to which it is fixed by suitable fusing techniques.

Most xerographic engines employ either a toner concentration sensor or measure the reflectance from a constant-potential solid area test patch to implement developability control. These approaches allow use of only a small fraction of the total Toner Concentration -Tribo (TC-Tribo) latitude space which is of special concern with color developer materials.

The challenge is to find a control strategy which, in the presence of sensor noise and drift, enables use of at least ¾ of the available $A_t$ latitude.

In conventional two-component xerographic development, the ability of a toner material to charge with a given carrier material is quantified as follows:

$$A_t = \text{Tribo} * (TC + C_0)$$

where Tribo is the average charge to mass ratio of toner, TC is the toner concentration in percent by weight, and $C_0$ is a constant. $A_t$ is a critical specification parameter for toner and developer; it tends to vary from batch to batch, with developer age, and with operating relative humidity. The variation with humidity is a special problem with many color toners, since this variation tends to be much larger than with comparable black toners. Considerable effort has been expended in recent years to formulate developer materials with improved $A_t$ stability, but variations of ±70% with respect to the nominal value remain common at environmental extremes.

The ability of the xerographic engine to tolerate large $A_t$ variations and still deliver acceptable print quality can be shown graphically via a TC-Tribo latitude plot, a typical example of which is shown in FIG. 1. This plot shows the locus of print quality specification boundaries at fixed (optimized) values of development and cleaning potential. The interior of the closed zone or area in FIG. 1 represents a region of acceptable print quality. Lines of constant $A_t$ cross the zone diagonally; those which intersect the closed zone represent allowable operating values in principle. For the example, as shown in FIG. 1, the range of potentially allowable $A_t$ values is 125 units, from 25 to 150.

In practice, differences between the toner consumption rate and the dispense rate will always produce fluctuations in toner concentration, even if $A_t$ remains constant. In any high quality xerographic engine, a developer control system must be provided to minimize those fluctuations in TC. As $A_t$ changes from its nominal value, each type of control system will follow a distinctive path through the latitude space. The net result is that each toner control approach can be characterized by a nominal control line and a control band (due to varying consumption, sensor noise and drift) in TC-Tribo latitude space. The overlap between this control band and the print quality acceptance zone defines the allowable range of $A_t$ values for a given control strategy. This range is always less than that shown in FIG. 1.

FIG. 2 shows a typical control line and control band (shaded area) for a toner control strategy based on the use of a toner concentration sensor mounted in the developer housing. The allowable $A_t$ range is only about 20 units; this is only ⅙ of the available latitude.

FIG. 3 shows a typical control line and control band for a toner control strategy based on the measurement of reflectance from a fixed-potential solid area test patch. The allowable $A_t$ range is about 40 units, or about ⅓ of the available latitude. This range would be adequate for many black developers, but it is too small for many color developers when exposed to humidity changes.

Following is a discussion of prior art, incorporated herein by reference, which may bear on the patentability of the present invention. In addition to possibly having some relevance to the patentability thereof, these references, together with the detailed description to follow hereinafter, may provide a better understanding and appreciation of the present invention.

U.S. Pat. No. 5,210,572 granted to McDonald et al on May 11, 1993 and assigned to the same assignee as the instant invention discloses a toner dispenser control strategy wherein Infra-Red Densitometer (IRD) readings of a developed toner patch in a tri-level imaging apparatus are compared to a target value stored in Non-Volatile Memory (NVM) and are also compared to the previous IRD reading. Toner dispensing decisions (i.e. addition or withholding) are based on both comparisons. In this manner, not only are IRD readings examined as to how far the reading is from the target value but they are examined as to current trend (i.e. whether the reading is moving away from or toward the target.

If the IRD reading indicates that the toner concentration is low but is heading toward the target then the amount of added toner is somewhat reduced. If the IRD reading indicates that the toner concentration is low and is heading away from target (getting lower) then some extra toner is dispensed.

U.S. Pat. No. 5,227,270 granted to Scheuer et al on Jul. 13, 1993 discloses a single pass tri-level imaging apparatus, wherein a pair of Electrostatic Voltmeters (ESV) are utilized to monitor various control patch voltages to allow for feedback control of Infra-Red Densitometer (IRD) readings.

The ESV readings are used to adjust the IRD readings of each toner patch. For the black toner patch, readings of an ESV positioned between two developer housing structures are used to monitor the patch voltage. If the voltage is above target (high development field) the IRD reading is increased by an amount proportional to the voltage error. For the color toner patch, readings using an ESV positioned upstream of the developer housing structures and the dark decay projection to the color housing are used to make a similar correction to the color toner patch IRD readings (but opposite in sign because, for color, a lower voltage results in a higher development field).

Another method of controlling toner dispense rate, useful in electronic printers utilizes the number of character print signals applied to print head. The print signals may be in character code and a statistical average take-out rate used to estimate toner depletion, or the signals may be picture elements (pixel) signals. See for example U.S. Pat. Nos. 3,529,546 and 4,413,264.

U.S. Pat. No. 4,847,659 describes an electrostatographic machine which replenishes toner in a developer mix in response to a toner depletion signal which represents the toner usage rate. The toner depletion signal is determined from the number of character print signals applied to a print head, or in other words, the number of pixels to be toned. The depletion signal is used in conjunction with a second signal, which represents a proportional toning contrast, such that the constant of proportionality between the toner depletion signal and a toner replenishment signal is adjusted according to the second signal.

U.S. Pat. No. 5,204,699 granted to Birnbaum et al on Apr. 20, 1993 relates to an apparatus for estimating the mass of toner particles developed on a latent electrostatic image. The apparatus includes converting means for approximating the mass of the toner required to develop an output pixel as a function of the image intensity signal which is used to control the exposure of the output pixel. Also included is summing means, responsive to the toner mass signal, which determines the sum of the approximated toner mass over a plurality of output pixels, thereby producing a sum signal representing the estimated toner mass developed on the output pixels.

U.S. Pat. No. 5,204,698 granted to LeSueur et al relates to a laser printer in which a latent image is generated on a circulating imaging member in accordance with digital image signals and subsequently developed with toner, the number of pixels to be toned is used as an indication of the rate at which toner is being depleted from the developer mixture. The device for dispensing fresh toner to the developer mixture is operated in pre-established relationship between the pixel count and the length of time for which the dispensing device is in operation. If the efficiency of the dispensing device falls, the pre-established relationship is adjusted so that the toner density in the developed images remains constant. If a predetermined level of adjustment is reached, it is taken as an indication that the supply of toner in the printer is low, and should be replenished.

U.S. Pat. No. 5,202,769 granted to Tadaomi Suzuki on Apr. 13, 1993 discloses image output apparatus including a circuit for counting the number of pixels of various color and gradation densities contained in the image data, a circuit for estimating, based on the counted number, the amount of toner that will be consumed during development of the image data; and means for controlling, based on the estimated amount, the actual amount of toner supplied for developing the image.

BRIEF SUMMARY OF THE INVENTION

According to the present invention, pixel count data is combined with toner test patch reflectance data during a brief toner rundown to determine the rate of change of density per unit change in toner concentration. During toner rundown, dispensing of toner is suspended for a period of time for effecting toner concentration reduction by approximately 0.25%. The change in TC is estimated by counting image pixels. Additionally, toner test patches are created and the reflectance thereof is measured for determining the change in toner density. The estimated TC change and the change in toner density are processed using linear regression to find the average change in density sensor output for the estimated change in TC which is referred to as the rundown slope.

The rundown slope is then compared to a target value. If it exceeds the target value by more than $\epsilon$ (a noise factor), the dispense setpoint is reduced by one unit. If the rundown slope is less than the target value by more than $\epsilon$, the dispense point is increased by one unit. The noise factor, $\epsilon$ is attributable to errors in pixel count or reflectance sensor drift.

According to the foregoing, the nominal control line and control band in TC-Tribo space is altered to produce a much wider usable $A_t$ range.

DETAILED DESCRIPTION OF THE PREFERRED EMBODIMENT OF THE INVENTION

The developability control of the present invention can be utilized in any type of printer or copier relying on two component development, i.e. development that uses carrier beads mixed with toner particles.

Figure 8:
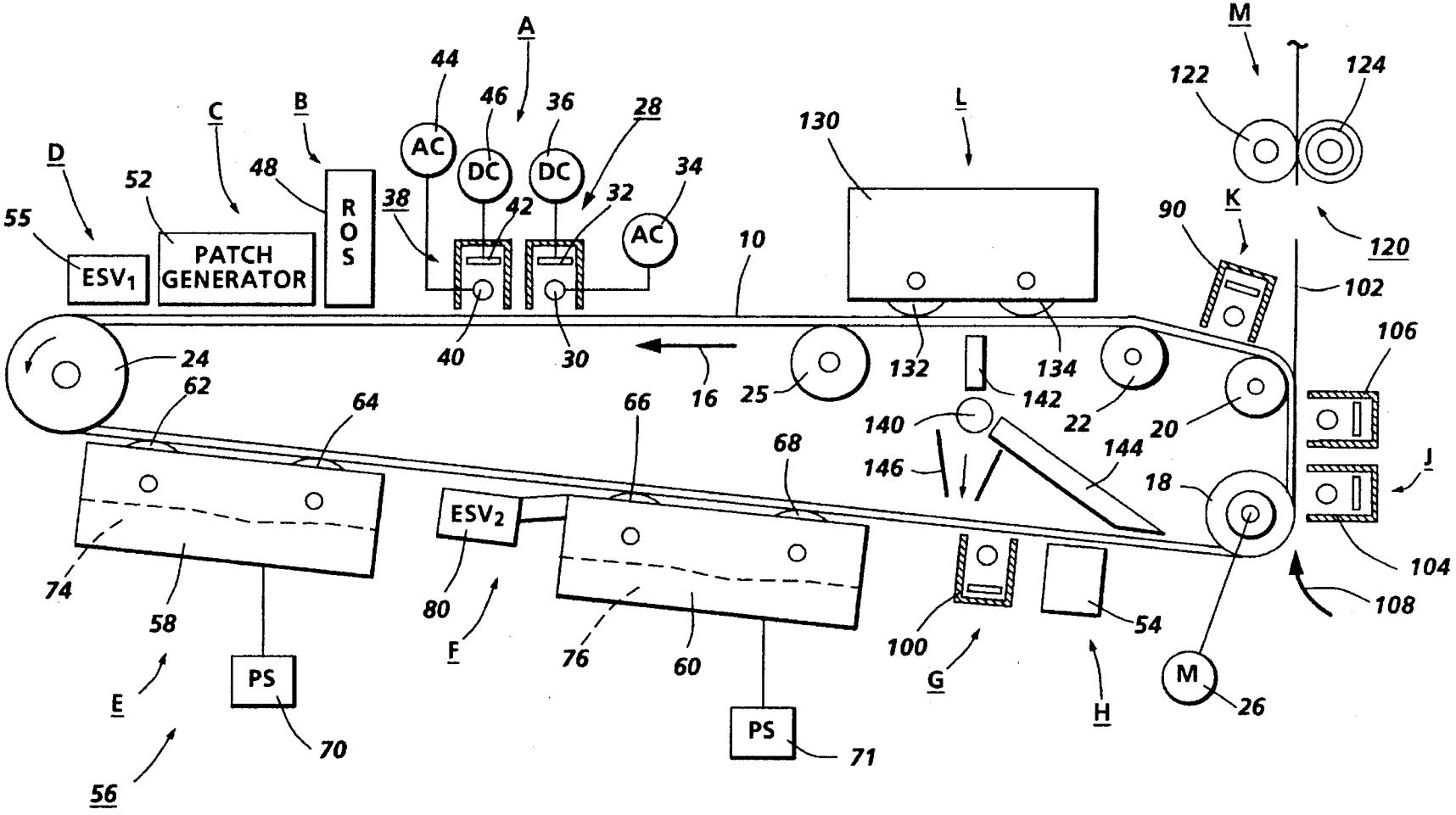
FIG. 8 is a block diagram illustrating the interconnection among active components of the processor of FIG. 7 and control devices utilized for controlling them.

As shown in FIG. 8, a highlight color printing apparatus in which the invention may be utilized comprises a xerographic processor module including a charge retentive member in the form of an Active Matrix (AMAT) photoreceptor belt 10 which is mounted for movement in an endless path past a charging station A, an exposure station B, a test patch generator station C, a first Electrostatic Voltmeter (ESV)

station D, a developer station E, a second ESV station F within the developer station E, a pretransfer station G, a toner patch reading station H where developed toner patches are sensed, a transfer station J, a preclean station K, cleaning station L and a fusing station M. Belt 10 moves in the direction of arrow 16 to advance successive portions thereof sequentially through the various processing stations disposed about the path of movement thereof. Belt 10 is entrained about a plurality of rollers 18, 20, 22, 25 and 24, the former of which can be used as a drive roller and the latter of which can be used to provide suitable tensioning of the photoreceptor belt 10. Motor 26 rotates roller 18 to advance belt 10 in the direction of arrow 16. Roller 18 is coupled to motor 26 by suitable means such as a belt drive, not shown. The photoreceptor belt may comprise a flexible belt photoreceptor. Typical belt photoreceptors are disclosed in U.S. Pat. No. 4,588,667, U.S. Pat. No. 4,654,284 and U.S. Pat. No. 4,780,385.

As can be seen by further reference to FIG. 8, initially successive portions of belt 10 pass through charging station A. At charging station A, a primary corona discharge device in the form of a dicorotron indicated generally by the reference numeral 28, charges the belt 10 to a selectively high uniform negative potential, $V_0$. The initial charge decays to a dark decay discharge voltage, $V_{ddp}$, ($V_{CAD}$). The dicorotron is a corona discharge device including a corona discharge electrode 30 and a conductive shield 32 located adjacent the electrode. The electrode is coated with relatively thick dielectric material. An AC voltage is applied to the dielectrically coated electrode via power source 34 and a DC voltage is applied to the shield 32 via a DC power supply 36. The delivery of charge to the photoconductive surface is accomplished by means of a displacement current or capacitative coupling through the dielectric material. The flow of charge to the P/R 10 is regulated by means of the DC bias applied to the dicorotron shield. In other words, the P/R will be charged to the voltage applied to the shield 32. For further details of the dicorotron construction and operation, reference may be had to U.S. Pat. No. 4,086,650 granted to Davis et al on Apr. 25, 1978.

A feedback dicorotron 38 comprising a dielectrically coated electrode 40 and a conductive shield 42 operatively interacts with the dicorotron 28 to form an integrated charging device (ICD). An AC power supply 44 is operatively connected to the electrode 40 and a DC power supply 46 is operatively connected to the conductive shield 42.

Next, the charged portions of the photoreceptor surface are advanced through exposure station B. At exposure station B, the uniformly charged photoreceptor or charge retentive surface 10 is exposed to a laser based output scanning device 48 which causes the charge retentive surface to be discharged in accordance with the output from the scanning device. Preferably the scanning device is a three level laser Raster Output Scanner (ROS). Alternatively, the ROS could be replaced by a conventional xerographic exposure device. The ROS comprises optics, sensors, laser tube and resident control or pixel board.

The photoreceptor, which is initially charged to a voltage $V_0$, undergoes dark decay to a level $V_{ddp}$ or $V_{CAD}$ equal to about −900 volts to form CAD (Charged Area Development) images. When exposed at the exposure station B it is discharged to $V_c$ or $V_{DAD}$ equal to about −100 volts to form a DAD (Discharged Area Development) image which is near zero or ground potential in the highlight color (i.e. color other than black) parts of the image. The photoreceptor is also discharged to $V_w$ or $V_{mod}$ equal to approximately minus 500 volts in the background (white) areas.

A patch generator 52 (FIGS. 7 and 8) in the form of a conventional exposure device utilized for such purpose is positioned at the patch generation station C. It serves to create toner test patches in the interdocument zone which are used both in a developed and undeveloped condition for controlling various process functions. An Infra-Red densitometer (IRD) 54 is utilized to sense or measure the reflectance level of test patches after they have been developed.

After patch generation, the P/R is moved through a first ESV station D where an ESV ($ESV_1$) 55 is positioned for sensing or reading certain electrostatic charge levels (i.e. $V_{DAD}$, $V_{CAD}$, $V_{Mod}$, and $V_{tc}$) on the P/R prior to movement of these areas of the P/R through the development station E.

At development station E, a magnetic brush development system, indicated generally by the reference numeral 56 advances developer materials into contact with the electrostatic latent images on the P/R. The development system 56 comprises first and second developer housing structures 58 and 60. Preferably, each magnetic brush development housing includes a pair of magnetic brush developer rollers. Thus, the housing 58 contains a pair of rollers 62, 64 while the housing 60 contains a pair of magnetic brush rollers 66, 68. Each pair of rollers advances its respective developer material into contact with the latent image. Appropriate developer biasing is accomplished via power supplies 70 and 71 electrically connected to respective developer housings 58 and 60. A pair of toner replenishment devices 72 and 73 (FIG. 7) are provided for replacing the toner as it is depleted from the developer housing structures 58 and 60.

Color discrimination in the development of the electrostatic latent image is achieved by passing the photoreceptor past the two developer housings 58 and 60 in a single pass with the magnetic brush rolls 62, 64, 66 and 68 electrically biased to voltages which are offset from the background voltage $V_{Mod}$, the direction of offset depending on the polarity of toner in the housing. One housing e.g. 58 (for the sake of illustration, the first) contains red conductive magnetic brush (CMB) developer 74 having triboelectric properties (i.e. negative charge) such that it is driven to the least highly charged areas at the potential $V_{DAD}$ of the latent images by the electrostatic development field ($V_{DAD}-V_{color\ bias}$) between the photoreceptor and the development rolls 62, 64. These rolls are biased using a chopped DC bias via power supply 70.

The triboelectric charge on conductive black magnetic brush developer 76 in the second housing is chosen so that the black toner is urged towards the parts of the latent images at the most highly charged potential $V_{CAD}$ by the electrostatic development field ($V_{CAD}-V_{black\ bias}$) existing between the photoreceptor and the development rolls 66, 68. These rolls, like the rolls 62, 64, are also biased using a chopped DC bias via power supply 72. By chopped DC (CDC) bias is meant that the housing bias applied to the developer housing is alternated between two potentials, one that represents roughly the normal bias for the DAD developer, and the other that represents a bias that is considerably more negative than the normal bias, the former being identified as $V_{Bias\ Low}$ and the latter as $V_{Bias\ High}$. This alternation of the bias takes place in a periodic fashion at a given frequency, with the period of each cycle divided up between the two bias levels at a duty cycle of from 5—10% (Percent of cycle at $V_{Bias\ High}$) and 90–95% at $V_{Bias\ Low}$. In the case of the CAD image, the amplitude of both $V_{Bias\ Low}$ and $V_{Bias\ High}$ are about the same as for the DAD housing case, but the waveform is inverted in the sense that the the bias on the CAD housing is at $V_{Bias\ High}$ for a duty cycle of 90–95%. Developer bias switching between $V_{Bias\ High}$ and $V_{Bias\ Low}$ is effected automatically via the power supplies 70 and 74. For further details regarding CDC biasing, reference may be had to U.S. patent application Ser. No. 440,913 filed Nov. 22, 1989 in the name of Germain et al and assigned to same assignee as the instant application.

In contrast, in conventional tri-level imaging as noted above, the CAD and DAD developer housing biases are set at a single value which is offset from the background voltage by approximately −100 volts. During image development, a single developer bias voltage is continuously applied to each of the developer structures. Expressed differently, the bias for each developer structure has a duty cycle of 100%.

Because the composite image developed on the photoreceptor consists of both positive and negative toner, a negative pretransfer dicorotron member 100 at the pretransfer station G is provided to condition the toner for effective transfer to a substrate using positive corona discharge.

Subsequent to image development a sheet of support material 102 is moved into contact with the toner image at transfer station J. The sheet of support material is advanced to transfer station J by conventional sheet feeding apparatus comprising a part of the paper handling module, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station J.

Transfer station J includes a transfer dicorotron 104 which sprays positive ions onto the backside of sheet 102. This attracts the negatively charged toner powder images from the belt 10 to sheet 102. A detack dicorotron 106 is also provided for facilitating stripping of the sheets from the belt 10.

After transfer, the sheet continues to move, in the direction of arrow 108, onto a conveyor (not shown) which advances the sheet to fusing station M. Fusing station M includes a fuser assembly, indicated generally by the reference numeral 120, which permanently affixes the transferred powder image to sheet 102. Preferably, fuser assembly 120 comprises a heated fuser roller 122 and a backup roller 124. Sheet 102 passes between fuser roller 122 and backup roller 124 with the toner powder image contacting fuser roller 122. In this manner, the toner powder image is permanently affixed to sheet 102 after it is allowed to cool. After fusing, a chute, not shown, guides the advancing sheets 102 to catch trays (not shown) for subsequent removal from the printing machine by the operator.

After the sheet of support material is separated from photoconductive surface of belt 10, the residual toner particles carried by the non-image areas on the photoconductive surface are removed therefrom. These particles are removed at cleaning station L. A cleaning housing 130 supports therewithin two cleaning brushes 132, 134 supported for counter-rotation with respect to the other and each supported in cleaning relationship with photoreceptor belt 10. Each brush 132, 134 is generally cylindrical in shape, with a long axis arranged generally parallel to photoreceptor belt 10, and transverse to photoreceptor movement direction 16. Brushes 132,134 each have a large number of insulative fibers mounted on base, each base respectively journaled for rotation (driving elements not shown). The brushes are typically detoned using a flicker bar and the toner so removed is transported with air moved by a vacuum source (not shown) through the gap between the housing and photoreceptor belt 10, through the insulative fibers and exhausted through a channel, not shown. A typical brush rotation speed is 1300 rpm, and the brush/photoreceptor interference is usually about 2 mm. Brushes 132, 134 beat against flicker bars (not shown) for the release of toner carried by the brushes and for effecting suitable tribo charging of the brush fibers.

Subsequent to cleaning, a discharge lamp 140 floods the photoconductive surface 10 with light to dissipate any residual negative electrostatic charges remaining prior to the charging thereof for the successive imaging cycles. To this end, a light pipe 142 is provided. Another light pipe 144 serves to illuminate the backside of the P/R downstream of the pretransfer dicorotron 100. The P/R is also subjected to flood illumination from the lamp 140 via a light channel 146.

Figure 7:
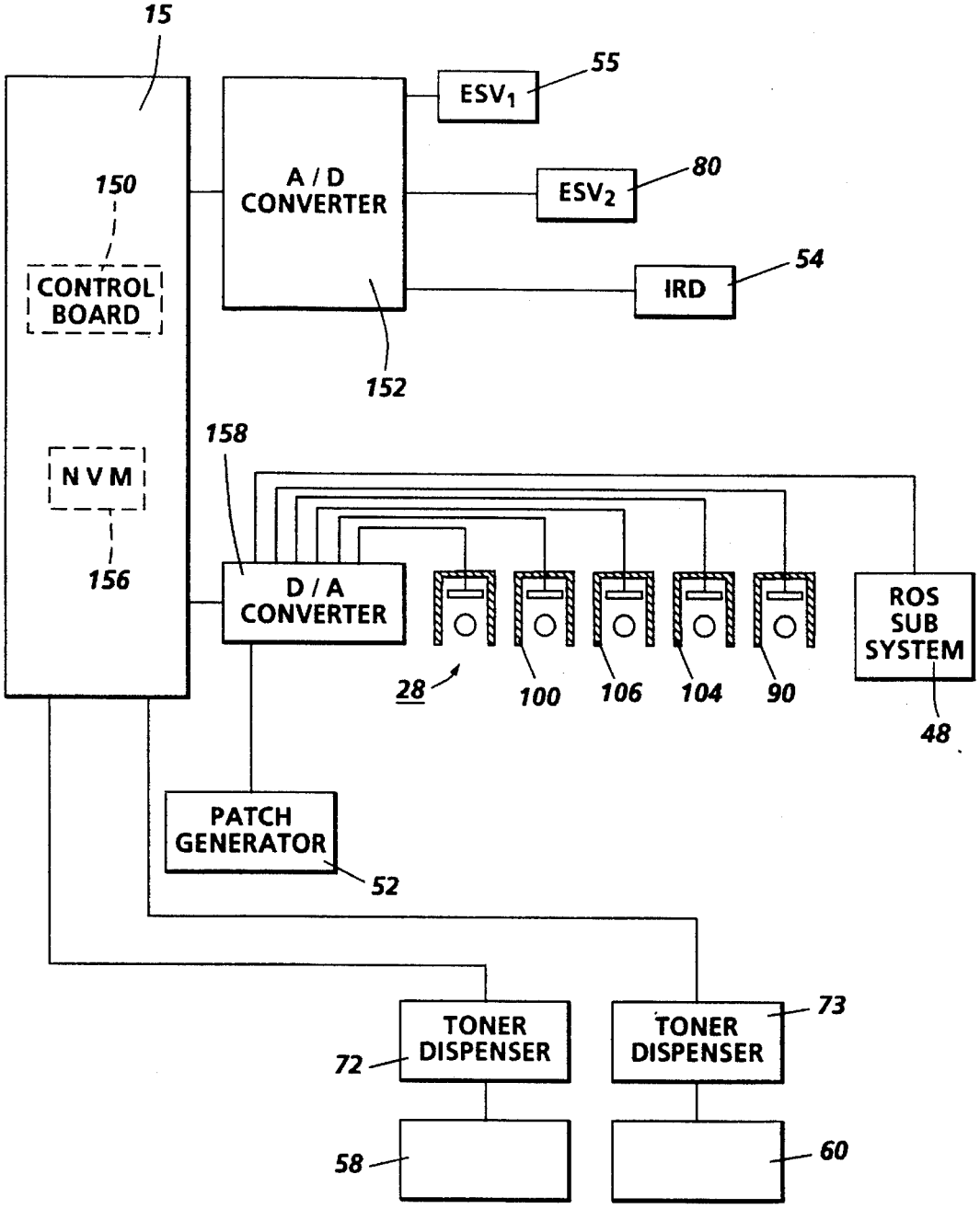
FIG. 7 is a schematic illustration of an image processor in which the development control of the present invention may be incorporated.

FIG. 7 depicts the interconnection among active components of the xerographic processor and the sensing or measuring devices utilized to control them. As illustrated therein, $ESV_1$, $ESV_2$ and IRD 54 are operatively connected to a control board 150 through an analog to digital (A/D) converter 152. $ESV_1$ and $ESV_2$ produce analog readings in the range of 0 to 10 volts which are converted by Analog to Digital (A/D) converter 152 to digital values in the range 0–255. Each bit corresponds to 0.040 volts (10/255) which is equivalent to photoreceptor voltages in the range 0–1500 where one bit equals 5.88 volts (1500/255).

The digital value corresponding to the analog measurements are processed in conjunction with a Non-Volatile Memory (NVM) 156 by firmware forming a part of the control board 150. The control board 150 and NVM 156 form an integral part of an Electronic SubSystem (ESS) 15. The digital values arrived at are converted by a digital to analog (D/A) converter 158 for use in controlling the dicorotrons 28, 90, 100, 104 and 106. Target values for use in setting and adjusting the operation of the active machine components are stored in NVM.

Figure 4:
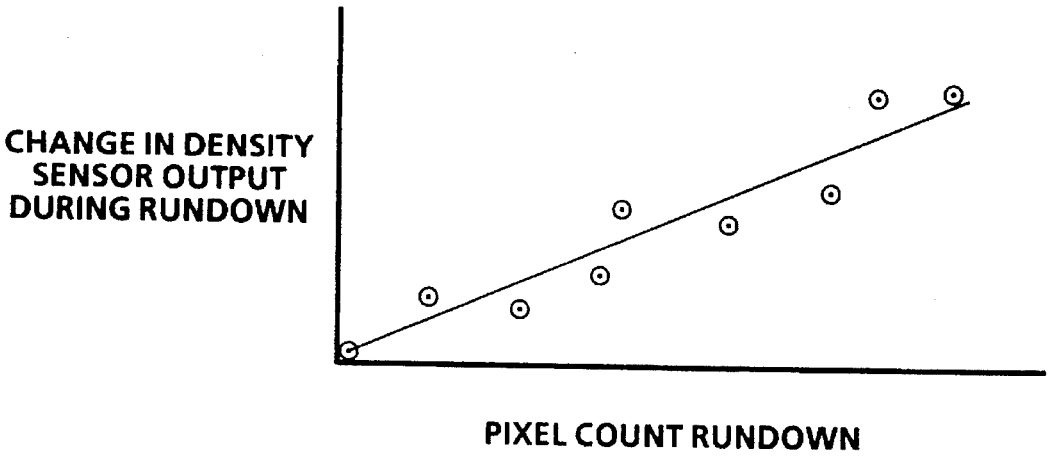
FIG. 4 is a plot of toner density change versus pixel count during a toner rundown period.

In accordance with the intents and purposes of the invention, the toner dispenser 72, by way of example, associated with the color developer housing 58 is switched off and a test patch is scheduled. This is effected at an arbitrary point during machine operation, when all measured control values are near nominal. As prints continue to be made, additional test patches are scheduled at approximately equal intervals of pixel count so that 6–10 patch readings are accumulated during a toner concentration decrease of approximately 0.25%. The number of prints made during this "toner rundown" will depend on the area coverage and development sump size (if the area coverage is unusually high or the sump unusually small, the process may need to be repeated to get 6–10 data points). At the end of the rundown, the toner dispenser is re-enabled and the system is allowed to return to its nominal state. The 6–10 pairs of data (test patch reading generated by the IRD and associated pixel count derived in the ESS by summing up the data stream bits used to drive the ROS 48) are then processed by the ESS using linear regression to find the average change in density sensor output per 0.25% TC change, which we will call the "rundown slope", as shown in FIG. 4.

The measured rundown slope is then compared to a target value stored in NVM. If it exceeds the target value by more than a predetermined value $\epsilon$ (a noise factor), the dispense setpoint is reduced by one unit. If the measured rundown slope is less than the target value by more than $\epsilon$, the dispense setpoint is increased by one unit. (Upper and lower bounds are placed on the dispense setpoint to prevent unstable states.) The entire rundown procedure is then repeated at regular intervals. The data acquisition, data storage, and computation involved in this invention are well within the capabilities of present and future microprocessor-based machine controllers.

Figure 1:
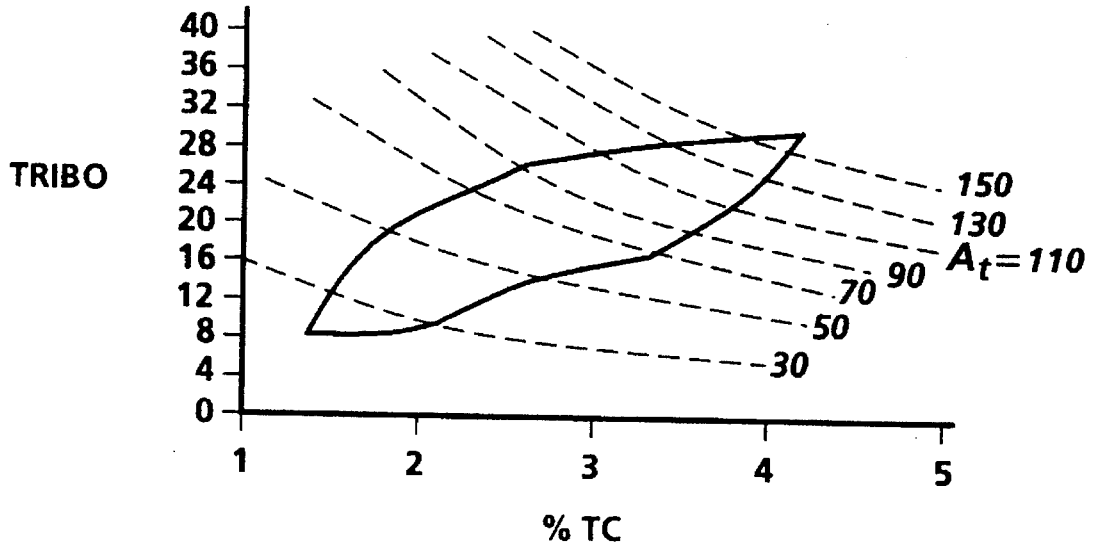
FIG. 1 is a plot of Toner Tribo versus Toner Concentration (TC) illustrating the locus of print quality specification boundaries at fixed values of development and cleaning potentials.
Figure 2:
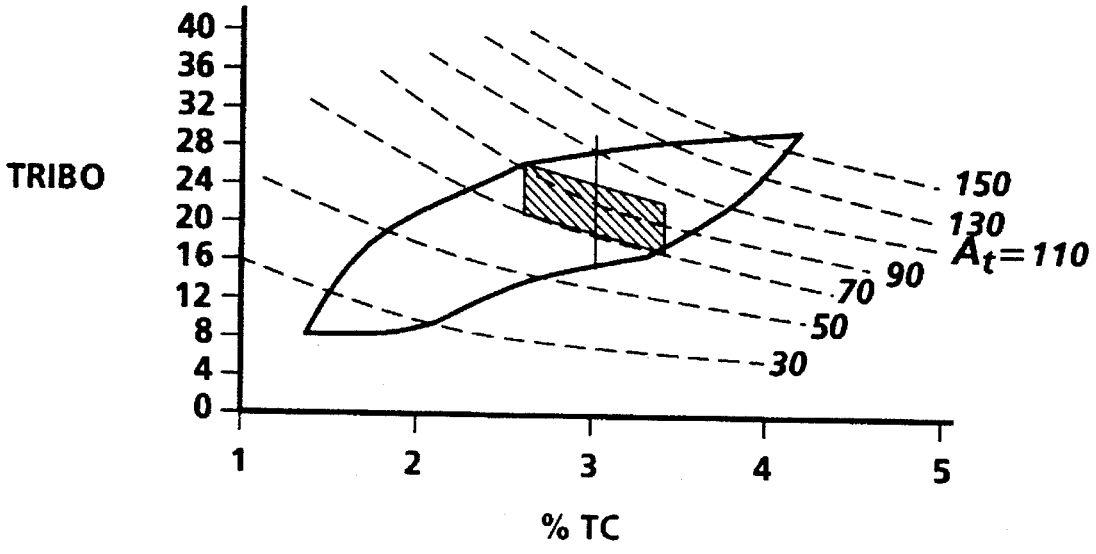
FIG. 2 is a plot of Toner Tribo versus Toner Concentration (TC) depicting a typical control line and control band for a toner control strategy based on the use of a toner concentration sensor mounted in the developer housing.
Figure 3:
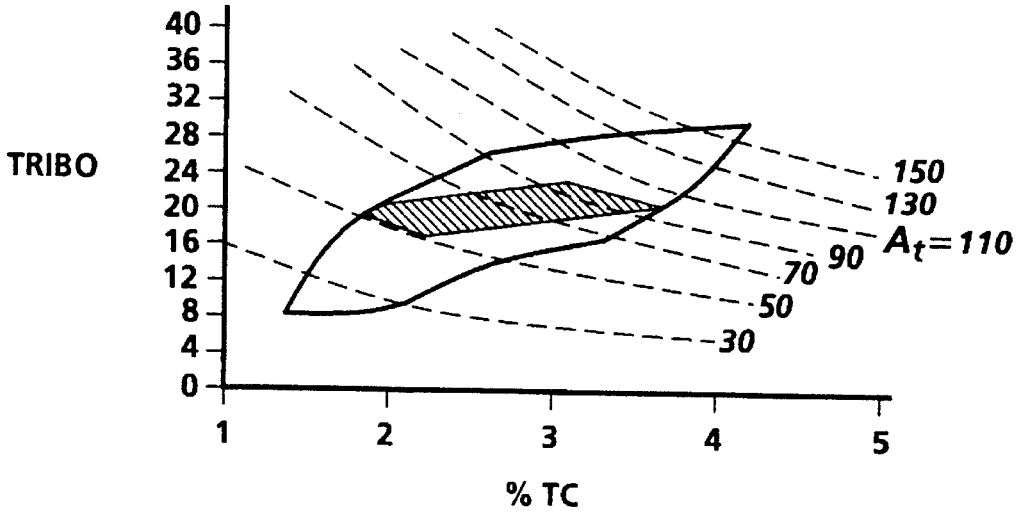
FIG. 3 is a plot of Toner Tribo versus Toner Concentration (TC) depicting a typical control line and control band for a toner control strategy based on the measurement of reflectance from a constant-potential solid area developed test patch.
Figure 5:
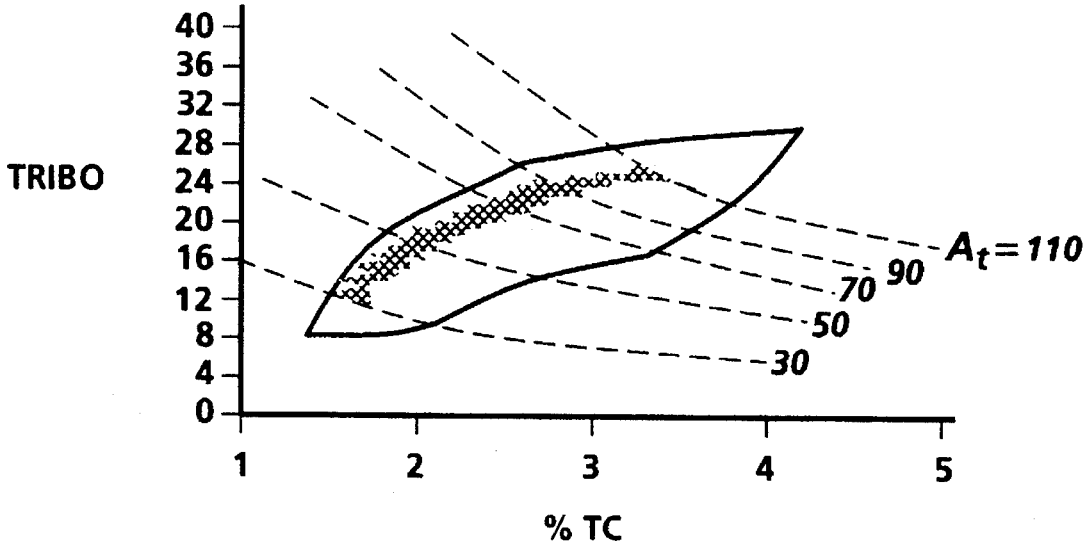
FIG. 5 is a plot of Tribo versus Toner Concentration depicting a noise-free latitude space based on the control strategy of the present invention.
Figure 6:
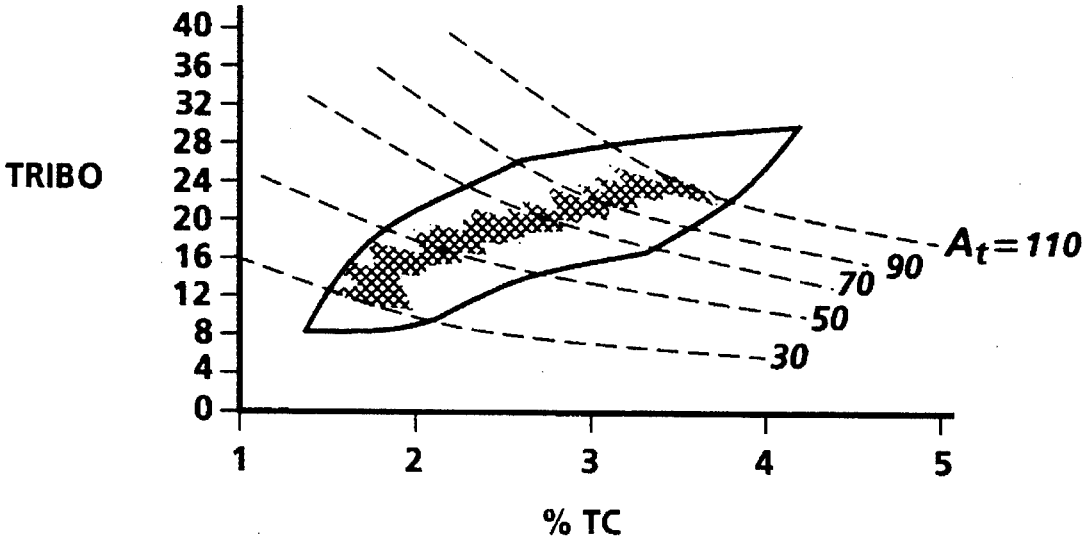
FIG. 6 is a plot of Tribo versus Toner Concentration depicting a latitude space, including noise, based on the control strategy of the present invention.

The net result is that the test patch density setpoint changes as $A_t$ varies, and the nominal control track and control band in TC-Tribo latitude space are altered to better match the shape of the print quality zone, thereby extending the useful range of $A_t$ values. FIG. 5 shows a typical outcome with this strategy for the nominal, noise-free case for the same marking system parameters shown in FIGS. 1–3. The range of allowable At values has been extended to >80 units. FIG. 6 shows the same case with noise and drift comparable to that in FIG. 3. The range of allowable At values has remained >80 units, showing that this strategy is robust.

As may now be appreciated, by combining pixel count information with the rate of change of density sensor data and using the result to adjust the toner dispense rate, this invention enables much more of the latitude space to be used. Potential benefits are improved print quality maintenance, relaxed $A_t$ specifications for toner and developer materials resulting in cost reduction and/or manufacturing yield improvement, and a significant increase in the allowable range of relative humidity variation.

What is claimed is:

1. In a method of creating toner patterns on a charge retentive surface, the steps including:

moving said charge retentive surface past a plurality of process stations including a charging station where said charge retentive surface is uniformly charged;

selectively discharging said charge retentive surface for forming electrostatic patterns therein, said electrostatic patterns comprising areas at different charge levels;

forming test patches on said charge retentive surface;

using a developer structure containing a mixture of toner and carrier particles, presenting toner material to said electrostatic patterns and said test patches;

using a toner dispenser, replenishing toner in said developer structure;

controlling the replenishment of toner by:

temporarily stopping toner dispensing until toner concentration is reduced by a predetermined amount;

generating a signal representative of toner concentration reduction;

sensing said test patches and generating signals representative of toner density;

using said signals representative of toner density and said signal representative of toner concentration reduction for determining a rundown slope;

comparing said rundown slope to a target value;

increasing or decreasing a rate of replenishing toner depending on whether said rundown slope is greater than or less than said target value.

2. The method according to claim 1 wherein said step of increasing said rate of replenishment comprises increasing said target value by a predetermined amount when said rundown slope is less than said target value by more than a predetermined noise factor.

3. The method according to claim 2 wherein said step of decreasing said rate of replenishment comprises reducing said target value by a predetermined amount when said rundown slope is greater than said target by a predetermined noise factor.

4. The method according to claim 3 wherein said predetermined amount is determined via pixel counting.

5. The method according to claim 4 wherein said predetermined amount is 0.25%.

6. The method according to claim 5 wherein said rundown slope is a ratio of change in density to change in toner concentration.

7. Apparatus for creating toner patterns on a charge retentive surface, said apparatus comprising:

a charge retentive surface;

means for moving said charge retentive surface past a plurality of process stations including a charging station where said charge retentive surface is uniformly charged;

means for selectively discharging said charge retentive surface for forming electrostatic patterns therein, said electrostatic patterns comprising areas at different charge levels;

means for forming test patches on said charge retentive surface;

developer structure containing a mixture of toner and carrier particles for presenting toner material to said electrostatic patterns and said test patches;

means for replenishing toner in said developer structure;

means for controlling the replenishment of toner including:

means for temporarily stopping toner dispensing until toner concentration is reduced by a predetermined amount;

means for generating a signal representative of toner concentration reduction;

means for sensing said test patches and generating signals representative of toner density;

means for determining a rundown slope using said signals representative of toner density and said signal representative of toner concentration reduction;

means for comparing said rundown slope to a target value;

means for increasing or decreasing a rate of replenishing toner depending on whether said rundown slope is greater than or less than said target value.

8. Apparatus according to claim 7 wherein said step of increasing said rate of replenishment comprises increasing said target value by a predetermined amount when said rundown slope is less than said target value by more than a predetermined noise factor.

9. Apparatus according to claim 8 wherein said step of decreasing said rate of replenishment comprises reducing said target value by a predetermined amount when said rundown slope is greater than said target by a predetermined noise factor.

10. Apparatus according to claim 9 wherein said predetermined amount is determined via pixel counting.

11. Apparatus according to claim 10 wherein said predetermined amount is 0.25%.

12. Apparatus according to claim 11 wherein said rundown slope is a ratio of change in density to change in toner concentration.

13. A device for controlling the replenishment of toner in a developer structure, said device comprising:

means for temporarily stopping toner dispensing until toner concentration is reduced by a predetermined amount;

means for generating a signal representative of toner concentration reduction;

means for sensing test patches on a charge retentive surface and generating signals representative of toner density;

means for determining a rundown slope using said signals representative of toner density and said signal representative of toner concentration reduction;

means for comparing said rundown slope to a target value;

means for increasing or decreasing a rate of replenishing toner depending on whether said rundown slope is greater than or less than said target value.

14. Apparatus according to claim 13 wherein said step of increasing said rate of replenishment comprises increasing said target value by a predetermined amount when said rundown slope is less than said target value by more than a predetermined noise factor.

15. Apparatus according to claim 14 wherein said step of decreasing said rate of replenishment comprises reducing said target value by a predetermined amount when said rundown slope is greater than said target by a predetermined noise factor.

16. Apparatus according to claim 15 wherein said predetermined amount is determined via pixel counting.

17. Apparatus according to claim 16 wherein said predetermined amount is 0.25%.

18. Apparatus according to claim 17 wherein said rundown slope is a ratio of change in density to change in toner concentration.

* * * * *